US006007370A

United States Patent [19]

Langridge

[11] Patent Number: 6,007,370

[45] Date of Patent: Dec. 28, 1999

[54] CRIMPABLE STRAIN RELIEF FERRULE HAVING A RETENTION TAB THEREUPON

[75] Inventor: Gary Langridge, St. Albans, United Kingdom

[73] Assignee: The Whitaker Corporation, Wilmington, Del.

[21] Appl. No.: 09/011,051

[22] PCT Filed: Aug. 6, 1996

[86] PCT No.: PCT/IB96/00781

§ 371 Date: Feb. 4, 1998

§ 102(e) Date: Feb. 4, 1998

[87] PCT Pub. No.: WO97/07566

PCT Pub. Date: Feb. 27, 1997

[30] Foreign Application Priority Data

Aug. 17, 1995 [GB] United Kingdom ..... 9516886

[51] Int. Cl.[6] ..... H01R 13/58

[52] U.S. Cl. ..... 439/455; 439/464

[58] Field of Search ..... 439/453–5, 449–50, 439/445–8, 460–65, 467, 470, 471, 472, 464

[56] References Cited

U.S. PATENT DOCUMENTS

| | | | |
|---|---|---|---|
| 2,192,165 | 2/1940 | Caldwell | 439/455 |
| 2,216,157 | 10/1940 | Charmoy | 439/453 |
| 2,226,610 | 12/1940 | Heyman | 439/471 |
| 2,236,764 | 4/1941 | Peterson | 439/461 |
| 2,398,002 | 4/1946 | Heyman | 439/471 |
| 2,508,638 | 5/1950 | Bricker | 439/455 |
| 4,447,104 | 5/1984 | Haggard . | |
| 4,693,550 | 9/1987 | Brown et al. . | |
| 4,767,355 | 8/1988 | Phillipson et al. . | |
| 4,767,356 | 8/1988 | Grappe . | |
| 4,929,195 | 5/1990 | Seidoh . | |
| 5,244,415 | 9/1993 | Marsilio et al. . | |
| 5,466,175 | 11/1995 | Onoda . | |

FOREIGN PATENT DOCUMENTS

| | | |
|---|---|---|
| 0 223 697 A1 | 5/1987 | European Pat. Off. . |
| 0 526 324 A1 | 5/1993 | European Pat. Off. . |
| 42 26 904 C2 | 2/1994 | Germany . |

*Primary Examiner*—Lincoln Donovan
*Attorney, Agent, or Firm*—Driscoll Nina

[57] ABSTRACT

A strain relief ferrule for attachment to a jacketed cable attaching the cable to a connector housing in a manner that transmits any load applied to the cable into the connector housing. The strain relief ferrule has a deformable body that is crimpable to the cable for attachment therewith. The ferrule is also attachable to said connector housing and characterized in that the deformable body carries at least one tab thereupon that after crimping of the strain relief ferrule, the tab is engageable by a retention member of the housing for attachment thereto.

10 Claims, 2 Drawing Sheets

CRIMPABLE STRAIN RELIEF FERRULE HAVING A RETENTION TAB THEREUPON

BACKGROUND OF THE INVENTION

1. Field of the Invention

This invention relates to connectors and in particular to crimpable strain relief ferrules that are attachable to a cable and a connector so that any load applied to the cable is transmitted to the connector housing so that the load does not effect the internal components of the connector.

2. Summary of the Prior Art

It is well known in electrical connectors to provide strain relief so that a load exerted on a cable is prevented from affecting the components within the connector. This is accomplished by anchoring a jacket of the cable directly to a connector housing. One way of doing so is to form the connector housing with a flange at a cable-receiving portion thereof and then by either spreading the jacket of the cable over the flange and attaching it thereto, such as by cable ties or crimp rings or by inserting the cable into the flange and then deforming the flange about the cable in a manner that retains the cable, such as by crimping. It is also known to over-mould a strain relief boot directly upon the cable that includes a strain relief tail extending along the cable and a strain relief body portion that may be held by the connector housing. Yet another known way of providing strain relief is to mould a strain relief body out of a deformable material and then use a metal or otherwise deformable crimp ring to deform the strain relief body such that the cable is tightly engaged therein. The body may then be attached to the housing.

While all of the afore going known strain relief apparatus perform admirably, it would be desirable to provide an improvement thereupon such that strain relief may be provided in a simpler and more economical manner. It would further be desirable to provide this strain relief in a manner that reduces the number of parts while still performing adequate strain relief. In addition, this strain relief should be provided in a manner that enables the cable to be easily coupled to the connector housing. Finally, it would be helpful if the strain relief were adapted so that the connector could not be assembled until complete crimping occurs.

SUMMARY OF THE INVENTION

These and other objects are accomplished by providing a strain relief ferrule for attachment to a jacketed cable and attaching said cable to a connector housing in a manner that transmits any load applied to the cable into the connector housing, the strain relief ferrule comprising a deformable body that is crimpable to said cable for attachment therewith, where said strain relief ferrule is also attachable to said connector housing, the strain relief ferrule being characterized in that the deformable body is only retainable in the connector housing upon complete crimping of the strain relief ferrule, the tab is engageable by a retention member of said housing for attachment thereto.

The objects of this invention are also accomplished by providing a connector comprising a connector housing for receiving contacts therein where the housing further includes a mating portion and a cable receiving portion, a jacketed cable having conductors therein to be terminated with the contacts, and a crimpable ferrule received about the cable and crimped thereto, where the cable and crimped ferrule thereupon are received in the cable receiving portion of the housing in a manner that transmits any load applied to the cable to the housing, the connector being characterized in that the crimpable ferrule is engageable by a retention feature within the cable receiving portion of the housing to retain the ferrule only when the ferrule has been completely crimped.

Advantageously then, a strain relief ferrule is provided that may be crimped to the jacket of a cable prior to assembly with the connector housing and then inserted directed into the connector housing and retained therewith. It is another advantage of this invention that by performing the crimping operation the conductors within the cable may be properly orientated. It is yet another advantage of this invention that the tabs of the strain relief ferrule may be easily engaged within the connector housing without the need for a cover thereover. It is yet another advantage of this invention that the cable with the ferrule thereupon cannot be seated within the connector housing until the ferrule has been crimped, thereby providing a check that proper attachment has occurred.

DETAILED DESCRIPTION OF THE PREFERRED EMBODIMENT

Figure 1:
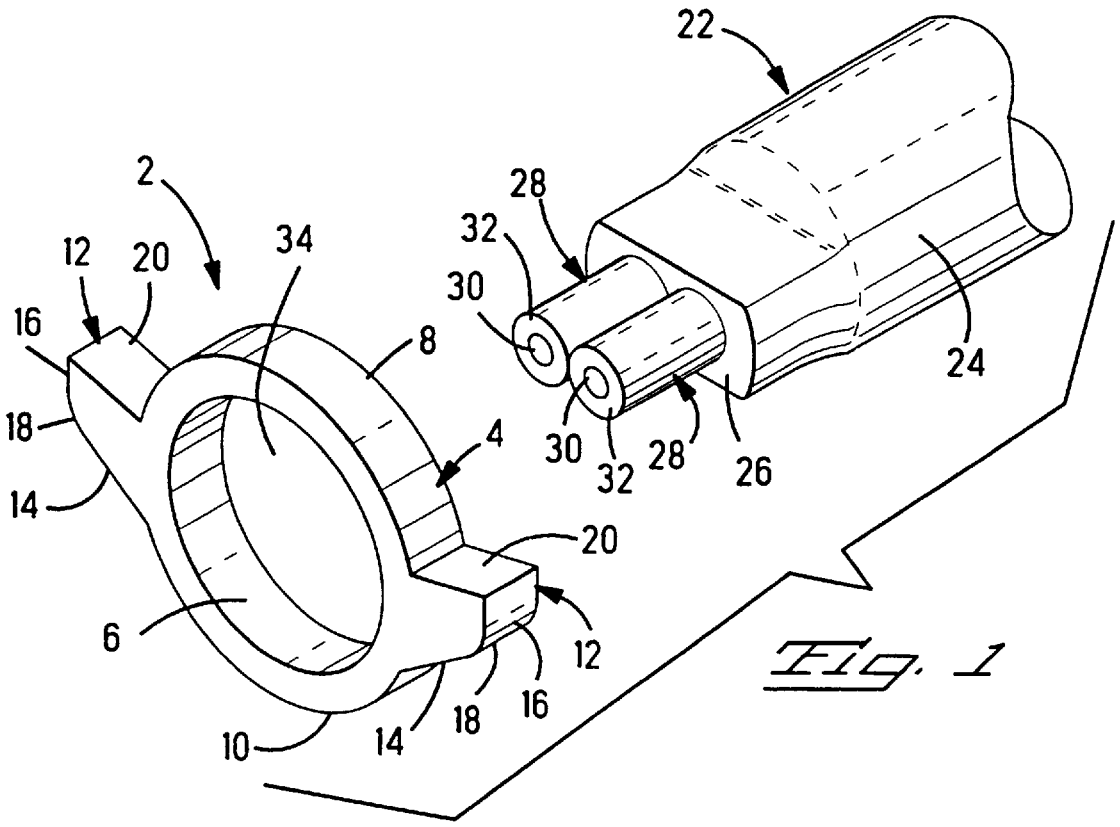
FIG. 1 is a perspective view of a crimpable strain relief ferrule according to the present invention and a jacketed cable upon which the ferrule is to be affixed.

With reference first to FIG. 1, a crimpable strain relief ferrule according to the present invention is shown generally at 2. The crimpable strain relief ferrule 2 includes a body portion 4 having a continuous internal cylindrical surface 6 and corresponding upper and lower outer surfaces 8,10 respectively. The upper and lower outer surfaces 8,10 meet through a pair of tabs 12. Each tab 12 includes a lower camming surface 14 that is angled outward and upward. The camming surfaces 14 are tangentially blended into end walls 16 through blend radii 18. The end walls 16 are joined to the upper/outer surface 8 by retention ledges 20. The retention ledges 20 are configured to be slightly undercut or back cut such that the intersection between the ledge 20 and the outer wall 16 is slightly above the inner section of the ledge 20 and the outer surface 8.

Also shown in FIG. 1 is a representative jacketed electrical cable at 22. Other cables may be used. The jacketed cable 22 includes an outer jacket 24 having a dressed forward end 26. In the particular cable 22 shown, a pair of insulated wires 28 extend beyond the dressed face 26 and include conductive cores 30 surrounded by an insulative layer 32. The jacketed cable 22 may include more or less conductive leads 28 and may take on other shapes than the generally round cross section shown herein. If the cable 22 were to take on another shape, such as an oval, it may be desirable to alter the shape of the interior 33 of the crimp ring 4, as defined by the interior surface 6, to more closely correspond with the shape the jacketing cable 22. In addition, the jacketed cable 22 may include additional members such as a strength member which would comprise kevlar strands extending outwardly therefrom.

Figure 2:
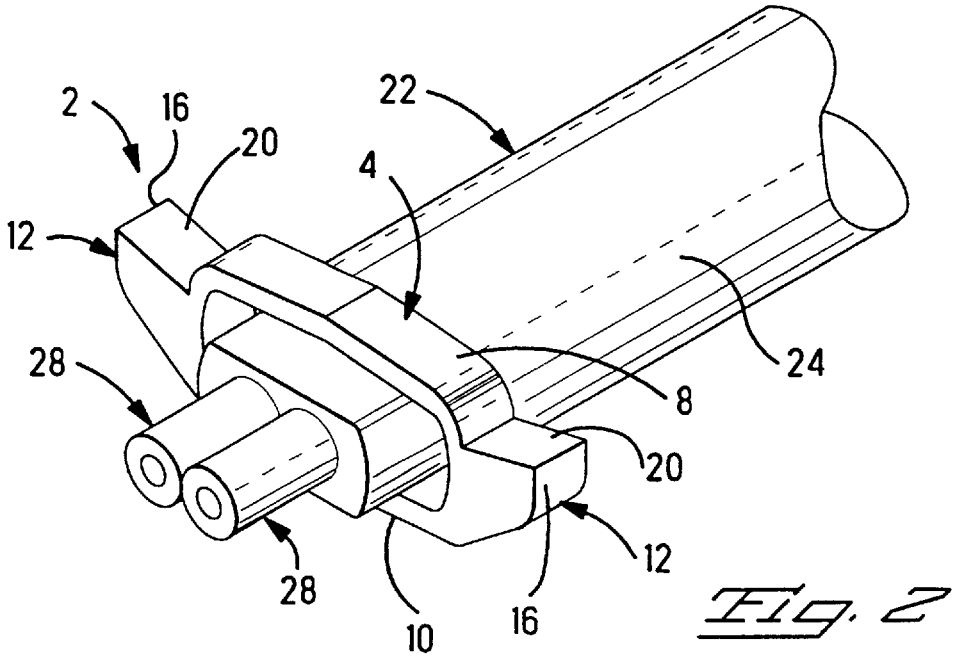
FIG. 2 is a perspective view of the components of FIG. 1 shown in an assembled form with the strain relief ferrule crimped to the cable.

With reference now to FIG. 2, the crimpable strain relief ferrule 2 is shown placed on the cable 22 about the jacket 24 with the leads 28 extending therethrough. Once properly positioned, the ferrule is crimped such that the upper and lower outer surfaces 8,10 are somewhat flattened, thereby expanding the ears 12 outward such that the width across the end surface of the tabs 12 is increased. The crimping operation reduces the height between the lower outer surface 10 and the retention ledges 20. In addition, the crimping will orient the conductive leads 28 in a proper side-by-side relation. If desired, an inner sleeve could be inserted along the conductors 28 so that any crimping forces transmitted into the cable 22 do not adversely affect the conductors therein.

Figure 3:
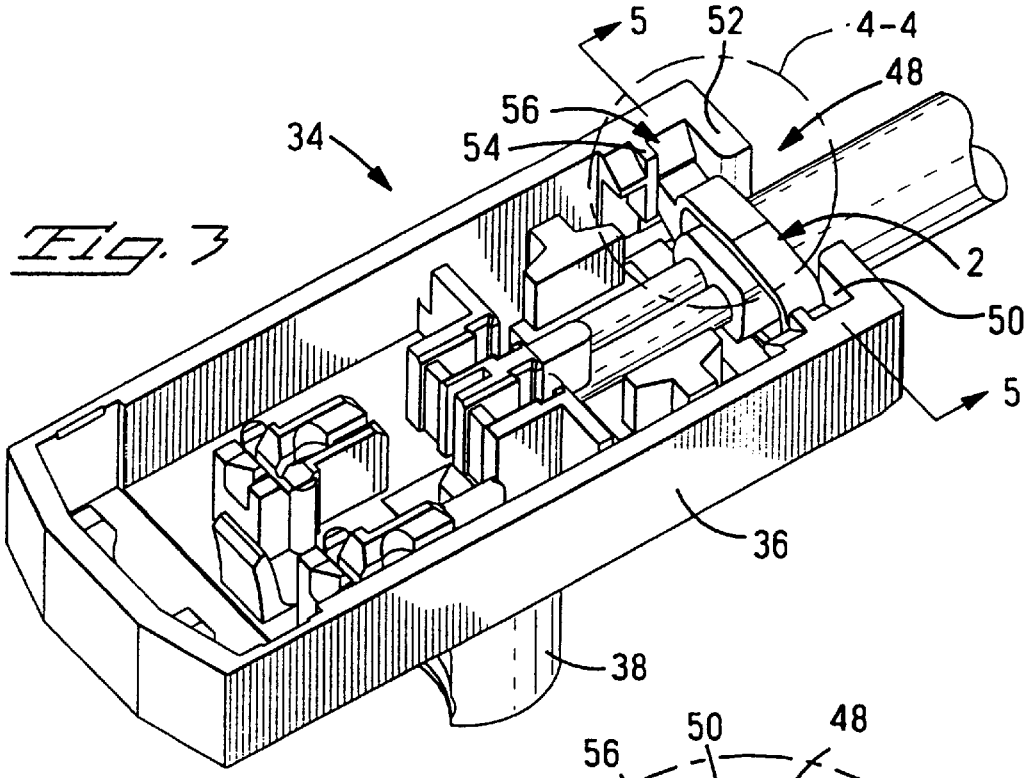
FIG. 3 is an upper perspective view of an electrical connector incorporating the assembly of FIG. 2 therein.
Figure 4:
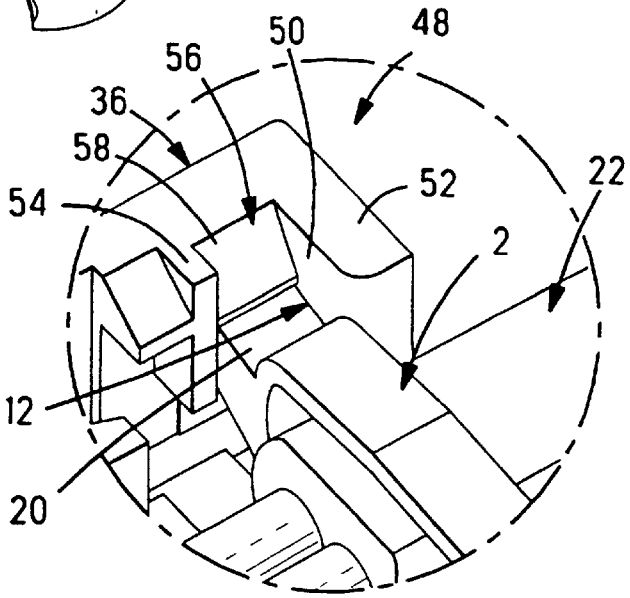
FIG. 4 is a detailed view of FIG. 3 taken at section 4—4.

With reference now to FIG. 3, an electrical connector that incorporates the present invention is shown generally at 34. The electrical connector 34 includes a connector housing 36 having a mating portion 38 for engaging a complementary device and a cable receiving portion 48 for receiving the cable 22 with the crimpable strain relief 2 affixed thereupon. The cable receiving portion 48 includes a channel 50 located between opposing wall sections 52,54. Located at opposite ends and within the channel 50 between the opposing walls 52,54 towards the open end thereof are latches 56 that each include a camming surface 58 angled to funnel into the channel 50 and an undercut lower ledge 60 connected thereto.

Figure 5:
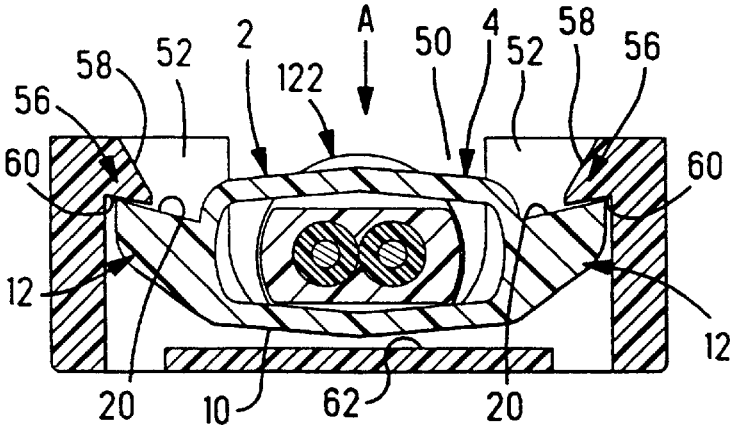
FIG. 5 is a cross-sectional view of the electrical connector of FIG. 3 taken along line 5—5.

As may be more readily observed in FIG. 5, in order to properly position the strain relief 2 within the connector housing 36, the strain relief 2 is positioned above the channel 50 so that the camming surfaces 58 of latches 56 and the camming surfaces 14 of the tabs 12 correspond so that in response to a downward force along arrow A, the latches 56 are displaced outward slightly until the strain relief 2 passes thereby and then resile back to their original position, thereby captivating the strain relief 2 therein. As shown, the undercut surfaces 60 of the latches 56 overlap the retention ledges 20 of the strain relief 2, thereby captivating the strain relief 2 and the cable 122 with the connector. As the tabs 12 and part of the body 4 are located between the opposing walls 52,54 in the channel 50 the strain relief 2 is also retained along the axis of the cable 22.

In addition, a bottom wall 62 prevents over insertion of the strain relief 2 and provides assurance that the strain relief body 4 is properly crimped as it is easily imaginable that the height between the lower outer surface 10 and the latching surfaces 20 needs to be reduced by way of crimping in order for the undercut surface 60 of the connector housing 36 to be able to engage the strain relief tabs 12. If complete crimping has not occurred the lower outer surface 10 would interfere with the base 62 before the retention ledges 20 pass the point of intersection between the camming surface 58 and the undercut wall 60 of the latches 56. By properly sizing the latches 56 it may be also assured that the necessary increase in the width of the crimpable strain relief 2 must occur before the tabs 12 of the strain relief 2 could be engaged by the corresponding latches 56 of the connector housing 36. Finally, as can be seen in FIG. 5, a further advantage is provided in that the cable may be affixed to the connector 34 without the need for a cover to prevent it from being displaced therefrom; however, the cover may be accommodated whereby assuring the upper outer surface 8 is properly crimped also by the upper surface 8 interfering with the cover in a manner similar to that described for the housing 36.

I claim:

1. An electrical connector for terminating a cable, the electrical connector comprising:

a connector housing having cover latching surfaces for attaching a cover thereto, a mating portion for engaging a complementary device and a cable receiving portion for receiving and anchoring that cable thereto, the cable receiving portion includes opposing latches located at opposite ends of a channel; and a strain relief ferrule for anchoring the cable to the connector housing where the strain relief ferrule includes a collapsible body having an interior surface defining an opening for receiving the cable and an outer surface having a pair of tabs extending outward thereform that include a retention ledge for engagement by the latches of the connector housing, the strain relief ferrule being crimpable to the cable and receivable in the channel, where there is a first distance between the outer surface and the retention ledge prior to crimping the strain relief ferrule upon the cable that is too large for engagement of the retention ledge by the latches and there is a second distance, reached upon complete crimping, that is smaller than the first distance whereupon the retention ledge is engagable by the latches so that, with the strain relief ferrule in a completely crimped condition and when the strain relief ferrule is received in the channel, the corresponding latches and tabs can be engaged, whereby the cable is anchored to the connector housing, and furthermore, where the distance between the latches at the channel and the cover latching surfaces is selected such that the strain relief ferrule must be crimped for the cover to be attached to the housing.

2. The electrical connector of claim 1, further characterized in that the engagement tabs have a first position relative the centre of the body in a radial direction prior to crimping and a second position, after complete crimping, that is further from the centre.

3. The electrical connector of claim 1, further characterized in that the tabs include an end wall disposed in a first position radially outward form the centre prior to crimping, upon complete crimping, the opposing end walls are moved further apart, thereby enabling engagement of the retention ledges by the housing latches.

4. The electrical connector of claim 1, further characterized in that the interior surface generally corresponds to the shape of the cable cross-section and the collapsible body has upper and lower outer surfaces separated by the pair of opposing tabs, the tabs having oppositely facing outer end walls and retention ledges facing in a common direction, the collapsible body being crimpable by displacing the upper and lower outer surfaces towards each other such that the distances therefrom to the retention ledges are reduced.

5. The electrical connector of claim 4, further characterized in that as a result of crimping, the outer end walls are moved further apart.

6. The electrical connector of claim 1, wherein a base is disposed relative the latches that engage the tabs of the strain relief ferrule such that the ferrule must be crimped for the latches to engage the tabs.

7. The electrical connector of claim 1, wherein the tabs and latches include cooperating camming surfaces that enable the strain relief ferrule to be inserted into and retained within the channel.

8. The electrical connector of claim 1, wherein the mating portion is disposed approximately perpendicular to the cable receiving portion of the connector housing.

9. The electrical connector of claim 7, wherein the latches are displaced as the tabs of the strain relief pass and then resile back, thereby captivating the strain relief in the channel.

10. An electrical connector for terminating a cable, the electrical connector comprising:

a connector housing having cover latching surfaces for attaching a cover thereto, a mating portion for engaging a complementary device and a cable receiving portion for receiving and anchoring that cable thereto, the cable receiving portion includes opposing latches located at opposite ends of a channel; and a strain relief ferrule for anchoring the cable to the connector housing where the strain relief ferrule includes a collapsible body having an interior surface defining an opening for receiving the cable and an outer surface having a pair of tabs extending outward thereform that include a retention ledge for engagement by the latches of the connector housing, the strain relief ferrule being crimpable to the cable and receivable in the channel, where the engagement tabs have an outer surface thereupon and are located at a first position relative the centre of the body in a radial direction thereform prior to crimping and a second position, after complete crimping, further from the centre so that the outer surfaces are further apart, such that with the strain relief ferrule in a completely crimped condition and when the strain relief ferrule is received in the channel, the corresponding latches and tabs can be engaged, whereby the cable is anchored to the connector housing, and furthermore, where the distance between the latches at the channel and the cover latching surfaces is selected such that the strain relief ferrule must be crimped for the cover to be attached to the housing.

* * * * *